United States Patent [19]

Blanchard

[11] 4,041,889

[45] Aug. 16, 1977

[54] MARINE PROPULSION DEVICE STEERING ASSEMBLY

[75] Inventor: Clarence E. Blanchard, Kenosha, Wis.

[73] Assignee: Outboard Marine Corporation, Waukegan, Ill.

[21] Appl. No.: 714,809

[22] Filed: Aug. 16, 1976

[51] Int. Cl.[2] ..... B63H 5/12

[52] U.S. Cl. ..... 115/18 R; 115/35; 114/150; 114/144 R

[58] Field of Search ..... 114/144 R, 144 RE, 144 A, 114/150, 151, 162, 169; 115/35, 37, 17, 18 R, 18 E; 74/480 B, 486 R, 492, 495, 498–500

[56] References Cited

U.S. PATENT DOCUMENTS

| | | | |
|---|---|---|---|
| 2,446,229 | 8/1948 | House | 115/35 |
| 3,091,977 | 6/1963 | Kiekhaefer | 115/18 R |
| 3,654,889 | 4/1972 | Bergstetd | 115/35 |
| 3,753,375 | 8/1973 | Colleti | 74/498 |
| 3,774,568 | 11/1973 | Borst | 115/18 R |

*Primary Examiner*—Trygve M. Blix
*Assistant Examiner*—D. W. Keen
*Attorney, Agent, or Firm*—Michael, Best & Friedrich

[57] ABSTRACT

Disclosed herein is an outboard motor including a lower unit comprising a propeller adapted for rotation under water, and a swivel bracket adapted for mounting to a transom bracket for vertical tilting movement about a generally horizontal axis. A kingpin assembly including a pivot shaft is supported by the swivel bracket for rotation about a generally vertical axis, the pivot shaft having fixed thereto a pinion and means for supporting the lower unit. A rack is located below the generally horizontal axis and engages the pinion. The rack is supported by the swivel bracket to afford generally horizontal movement of the rack, which horizontal movement effects rotation of the pivot shaft and the lower unit about the vertical axis. Hydraulically activated plunger mechanisms connected to the rack are provided for effecting horizontal movement of the rack and thereby affording control of the rotation of the lower unit about the vertical axis.

10 Claims, 4 Drawing Figures

MARINE PROPULSION DEVICE STEERING ASSEMBLY

BACKGROUND OF THE INVENTION

The invention relates generally to marine propulsion devices such as outboard motors. More specifically, the invention relates to marine propulsion devices which include a lower unit and which have a steering assembly for affording control of rotation of the lower unit about a vertical axis. Still more specifically, the invention relates to marine propulsion devices including a rack and pinion type steering assembly.

Prior marine propulsion devices having steering assemblies are disclosed in the following U.S. Pat. Nos.

Breunich — 3,095,849, July 2, 1963;
Holzhauser — 2,598,383; May 27, 1952;
Kiekhaefer — 3,091,977; June 4, 1963;
Schroeder — 2,891,498; June 23, 1959;
Binder — 2,583,407; Jan. 2, 1952;
Harris — 3,602,181; Aug. 31, 1971;
Smith — 3,799,102; Mar. 26, 1974;
Smith — 3,874,321; Apr. 1, 1975.

SUMMARY OF THE INVENTION

The invention provides a marine propulsion device including a lower unit comprising a propeller adapted for rotation under water, and a swivel bracket adapted for mounting to a transom bracket for vertical tilting movement about a generally horizontal axis. A kingpin assembly including a pivot shaft is supported by the swivel bracket for rotation about a generally vertical axis, which pivot shaft has fixed thereto a pinion and means for supporting the lower unit. A rack is located below the generally horizontal axis and is in engagement with the pinion, which rack is supported by the swivel bracket to afford generally horizontal rack movement. The horizontal movement of the rack effects rotation of the pivot shaft and the lower unit about the vertical axis. Steering control means are provided for effecting horizontal movement of the rack and thereby affording control of the rotation of the lower unit about the vertical axis.

Also in accordance with an embodiment of the invention, there is provided a marine propulsion device wherein the swivel bracket includes a generally vertical bore which receives the pivot shaft, and a generally horizontal cross bore which receives the rack. The vertical bore intersects the horizontal cross bore so that the pinion fixed to the pivot shaft engages the rack.

Also in accordance with an embodiment of the invention, there is provided a marine propulsion device including a lower unit comprising a propeller adapted for rotation under water, and a swivel bracket having a generally vertical bore and a generally horizontal cross bore which intersects the vertical bore. A kingpin assembly including a pivot shaft is supported within the vertical bore for rotation about a generally vertical axis, which pivot shaft has fixed thereto a pinion and means for supporting the lower unit. The rack engages the pinion and is supported within the horizontal bore to afford generally horizontal movement of the rack. The horizontal movement of the rack effects rotation of the pivot shaft and the lower unit about the vertical axis. Steering control means are provided for effecting horizontal movement of the rack and thereby affording control of the rotation of the lower unit about the vertical axis.

Also in accordance with an embodiment of the invention, there is provided a steering assembly for an outboard motor having a lower unit. The steering assembly includes a swivel bracket having a generally vertical bore and a generally horizontal cross bore which intersects the vertical bore. The swivel bracket is adapted for mounting to a transom bracket adapted to be secured adjacent the upper edge of a boat transom. The swivel bracket is mounted to the transom bracket to afford vertical tilting movement of the swivel bracket about a generally horizontal axis. A kingpin assembly including a pivot shaft is supported within the vertical bore for rotation about the generally vertical axis, and the pivot shaft has fixed thereto a pinion and means for supporting the lower unit. A rack is located below the upper edge of the boat transom and below the generally horizontal axis. The rack engages the pinion and is supported within the horizontal cross bore to afford generally horizontal movement of the rack. The horizontal movement of the rack effects rotation of the pivot shaft and the lower unit about the vertical axis. Steering control means are provided for effecting horizontal movement of the rack and thereby affording control of rotation of the outboard motor about the vertical axis.

Also in accordance with an embodiment of the invention, there is provided a marine propulsion device wherein the pivot shaft has an upper end and a lower end, wherein the pinion is spaced between the ends of the pivot shaft and wherein the lower unit supporting means comprises an upper mounting member secured to the upper end of the pivot shaft and a lower mounting member secured to the lower end of the pivot shaft.

Also in accordance with an embodiment of the invention, there is provided a marine propulsion device wherein the steering control means comprises hydraulic control means.

Also in accordance with an embodiment of the invention there is provided a marine propulsion device wherein the horizontal cross bore of the swivel bracket includes an outer opening which receives the rack, and wherein the steering control means comprises hydraulic means including sealing means engaging the horizontal cross bore outer opening.

Also in accordance with an embodiment of the invention, there is provided a marine propulsion device wherein the steering control means comprises a threaded sleeve secured to the rack, a rotary cable having a threaded member rotatably engaged within the sleeve for effecting horizontal movement of the rack, and means for preventing axial movement of the rotary cable.

One of the principal features of the invention is the provision of a marine propulsion device including a lower unit comprising a swivel bracket adapted for vertical tilting movement about a generally horizontal axis, a kingpin assembly including a pivot shaft rotatably supported about a vertical axis by the swivel bracket and having fixed thereto a pinion and means for supporting the lower unit, a rack located below the generally horizontal axis and being in engagement with the pinion, and steering control means for effecting horizontal movement of the rack so as to thereby afford control of the rotation of the lower unit about the vertical axis.

Another of the principal features of the invention is the provision of a marine propulsion device comprising a swivel bracket having a generally vertical bore and a generally horizontal cross bore which intersects the vertical bore, a kingpin assembly including a pivot shaft and pinion fixed thereto received within the vertical bore, a rack supported within the horizontal bore for engagement with the pinion, and steering control means for effecting horizontal movement of the rack. Thus the marine propulsion device includes a sealed steering assembly in which the rack and pinion are located within the swivel bracket.

Another of the principal features of the invention is the provision of a steering assembly for an outboard motor having a lower unit comprising a swivel bracket adapted for mounting to a transom bracket adapted to be secured adjacent the upper edge of a boat ransom, a kingpin assembly including a pivot shaft rotatably supported by the swivel bracket and having fixed thereto a pinion and means for supporting the lower unit, and a rack engaging the pinion to effect rotation of the pivot shaft and lower unit, which rack is located below the upper edge of the boat transom and below the generally horizontal axis so as to thereby enable use of an outboard motor having an overall reduction in height, a relatively lower center of gravity, and increased stability for boating applications.

Other features and advantages of the embodiments of the invention will become known by reference to the following general description, the appended claims and drawings.

DRAWINGS

Figure 1:
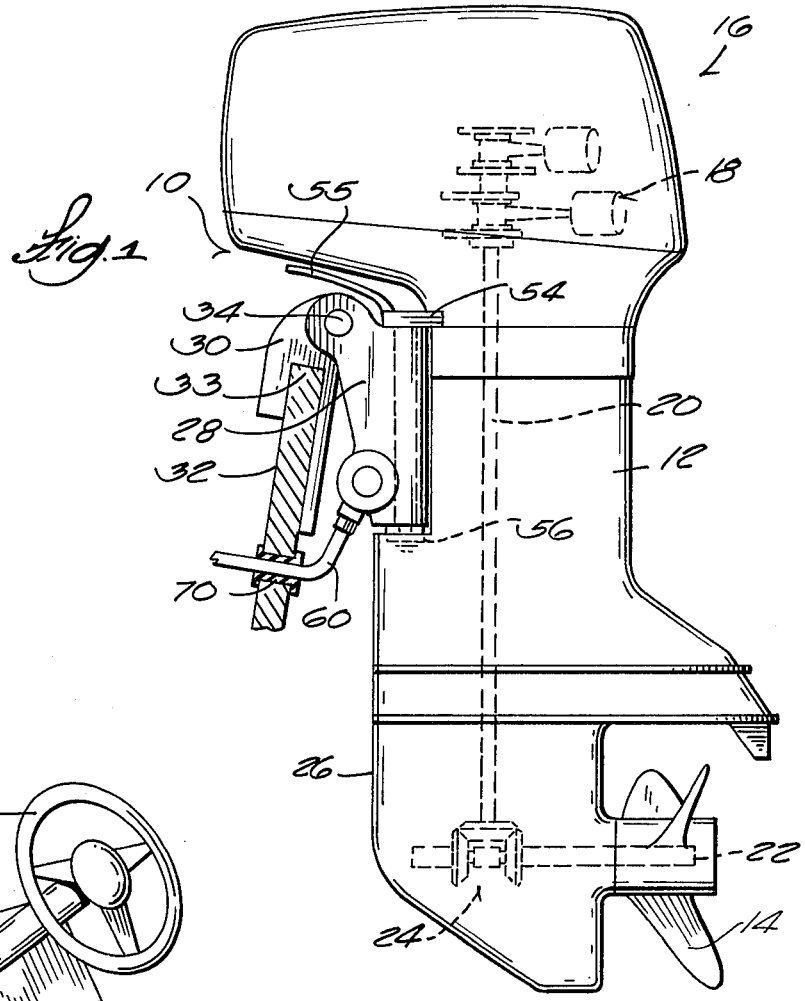
FIG. 1 is a diagrammatic side elevational view of a marine propulsion device embodying various of the features of the invention.

Before explaining the embodiments of the invention in detail, it is to be understood that the invention is not limited in its application to the details of the construction and the arrangement of components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

GENERAL DESCRIPTION

Shown in the drawings is a marine propulsion device in the form of an outboard motor 10 comprising a lower unit 12 having a propeller 14 adapted for rotation under water. The outboard motor10 conventionally includes a power head 16 which has an engine 18 and which is carried on the lower unit 12. The lower unit 12 houses a drive shaft 20 interconnected with a propeller shaft 22 by a transmission 24 located in a gear case 26 to drive the propeller 14.

The marine propulsion device or outboard motor 10 also comprises a steering assembly which includes a swivel bracket 28 preferably adapted for mounting to a transom bracket 30 which, in turn, is adapted for mounting to a boat transom 32 (partically shown). In the illustrated construction, the swivel bracket 28 is mounted for vertical tilting movement about a generally horizontal axis by conventional means such as through the use of a pivot pin 34 which interconnects the transom bracket 30 and the swivel bracket 28.

A kingpin assembly 36 which includes a pivot shaft 38 is supported by the swivel bracket 28 for rotation about the generally vertical axis of the pivot shaft 38. The pivot shaft 38 has fixed thereto a pinion 40 and means for supporting the lower unit 12. Various arrangements are possible for securing the pinion 40 to the pivot shaft 38. As shown in the illustrated construction, in order to prevent rotation of the pinion 40 with respect to the pivot shaft 38, the pinion 40 includes a grooved interior bore 41 which is keyed to a splined intermediate portion 43 of the pivot shaft 38. Downward axial movement of the pinion 40 is prevented by a washer or spacer 25 which is retained on the pivot shaft 38 below the pinion 40 by conventional means such as by use of a spring clip 27 suitably secured to pivot shaft 38.

The pivot shaft 38 includes means for supporting the lower unit 12. While various arrangements are possible, preferably such means comprised an upper mounting member secured to the upper end of the pivot shaft and a lower mounting member secured to the lower end of the pivot shaft. As shown in the illustrated construction, the upper mounting member preferably comprises a yoke 54 which is conventionally secured to the lower unit 12 in any suitable manner. The yoke 54 preferably includes a forwardly extending steering bracket 55. The lower mounting member preferably comprises a threaded extension 56 also suitably adapted for connection to the lower unit.

A rack 42 is supported by the swivel bracket 28 to afford generally horizontal movement of the rack. The rack 42 includes teeth 44 engaged with the pinion 40. Horizontal movement of the rack 42 effects rotation of the pivot shaft 38 about its generally vertical axis. Since the pivot shaft 38 includes the yoke 54 and extension 56 secured to the lower unit 12, horizontal movement of the rack 40 also effects rotation of the lower unit 12 about the generally vertical axis of the pivot shaft 38.

Various arrangements are possible for supporting the pivot shaft 38 for rotation and for supporting the rack 42 for horizontal movement. In the illustrated construction, the swivel bracket 28 includes a generally vertical bore 48 which receives the pivot shaft 38, and also includes a generally horizontal cross bore 50 having a circular bearing 49 which receives the rack 42. The vertical bore 48 intersects the horizontal cross bore 50 so that the pinion 40 fixed to the pivot shaft 38 engages the teeth 44 of the rack 42. The swivel bracket 28 preferably includes an upper bearing surface 51 surrounding the vertical bore 48 which supports the lower surface of the yoke 54 to facilitate rotation of the pivot shaft 38 and the lower unit 12 secured thereto.

While various arrangements are possible, the generally horizontal cross bore 50 and the rack 42 are preferably located below the generally horizontal axis defined by the axis of the pivot pin 34 which interconnects the transom bracket 30 and the swivel bracket 28. In the illustrated construction (see FIG. 1) the rack is located adjacent the lower end of the swivel bracket and below the pivot pin 34 and an upper edge 33 of the boat transom 32.

Steering control means are provided for effecting horizontal movement of the rack 42 and for thereby affording control of rotation of the lower unit 12 about the vertical axis of the pivot shaft 38. Various arrangements are possible. As shown in the illustrated construction in FIG. 3, the steering control means comprises hydraulic control means 57.

The hydraulic control means 57 comprise generally cylindrical end members 58, each having an end plug 74 and at least one inlet 59 coupled to a source of actuating fluid by hydraulic lines 60. Each of the cylindrical end members 58 includes a plunger mechanism comprising a rod 61 having one end extending into the horizontal cross bore 50 and being secured to one end of the rack 42, and having the other end secured to a sealing washer or piston 63. The sealing washers 63 sealing engage the inner bores of the cylindrical end members 58 and each are preferably actuated by fluid for displacement between a pair of spaced inlets 59, thereby affecting horizontal movement of the rods 61 and the rack 42.

Various conventional arrangements can be utilized to control the flow of fluid through the hydraulic lines 60. In the illustrated construction, a conventional fluid actuator utilizing a worm and wheel arrangement, (represented diagrammatically as 72) is coupled to the hydraulic lines 60 and to a boat steering wheel 66. Rotation of the steering wheel 66 activates the fluid actuator mechanism 72 which in turn causes fluid under pressure to flow through hydraulic lines 60 to displace the plunger mechanisms thereby effecting horizontal movement of the rack 42. Horizontal movement of the rack 42 effects rotation of the pinion and pivot shaft 38 and hence the steering control means affords control of the rotation of the lower unit 12 about the vertical axis of the pivot shaft 38.

The horizontal cross bore 50 preferably includes an outer opening 68 which receives the rack 42. The hydraulic control means preferably includes sealing means which engage the horizontal cross bore opening 68. In the illustrated construction, such sealing means comprises flanges 62 which form part of the end members 58 and which sealingly engage with the swivel bracket 28 adjacent the horizontal cross bore outer openings 68.

Figure 3:
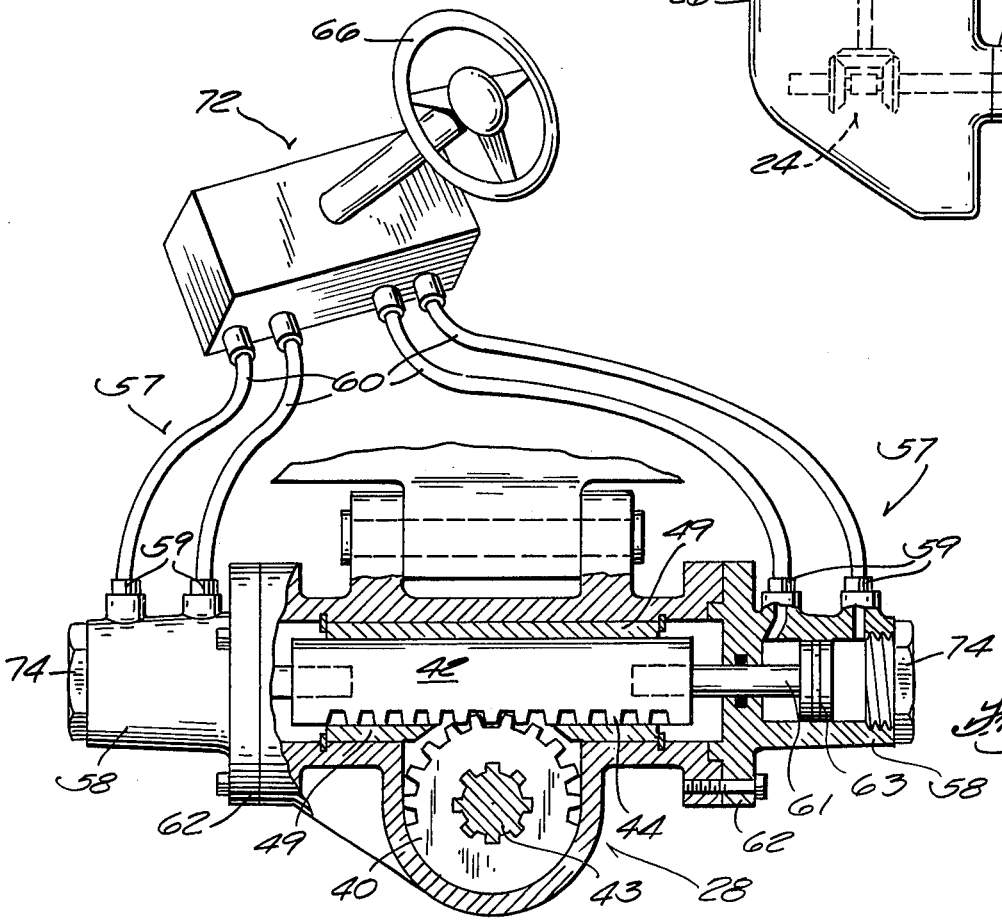
FIG. 3 is a partially diagrammatic view of a steering control mechanism, which figure includes a partially broken away top sectional view of the assembled steering assembly taken along line 3—3 in FIG. 2.
Figure 2:
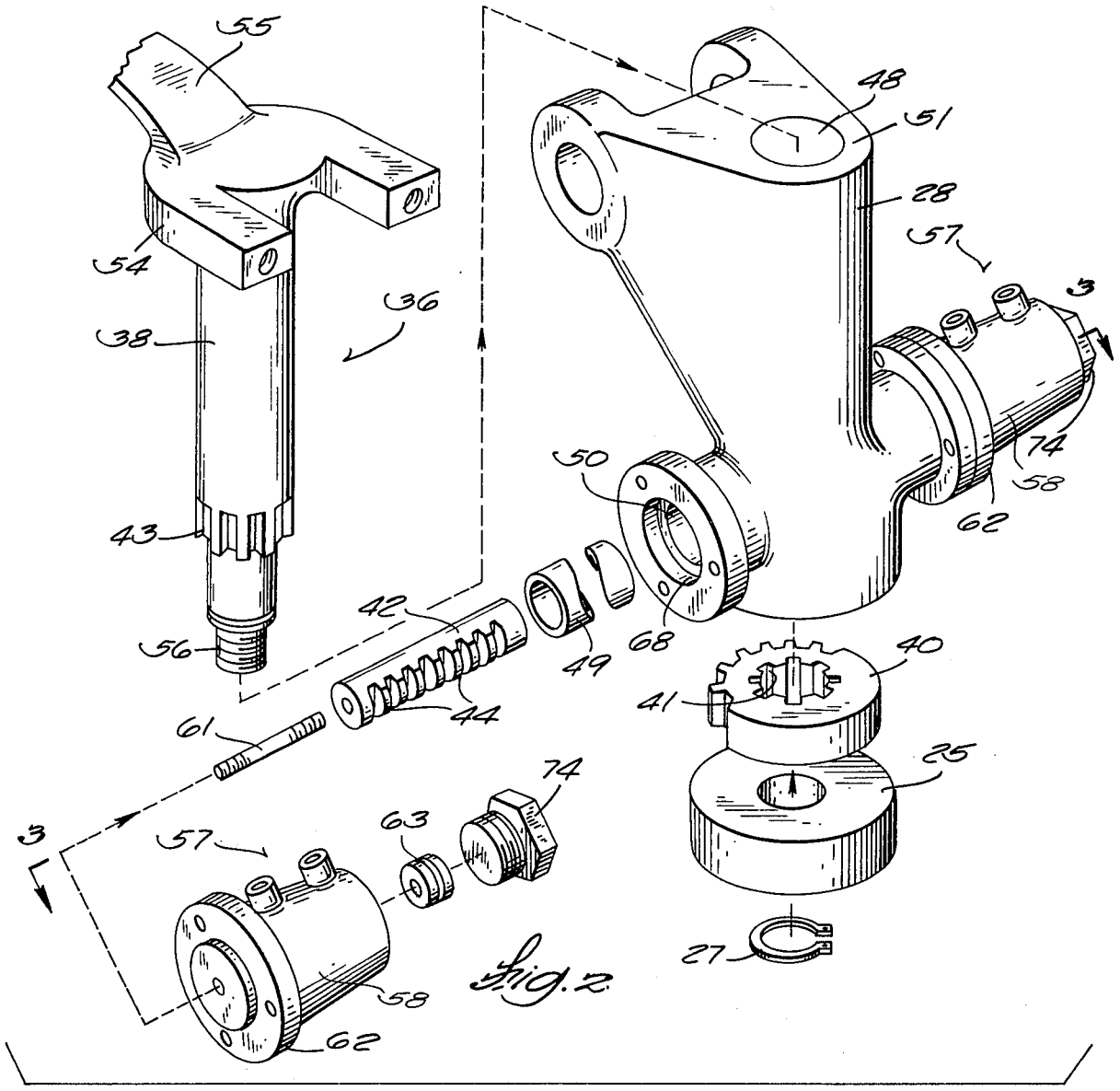
FIG. 2 is an exploded perspective view of a steering assembly supporting the lower unit shown in FIG. 1.
Figure 4:
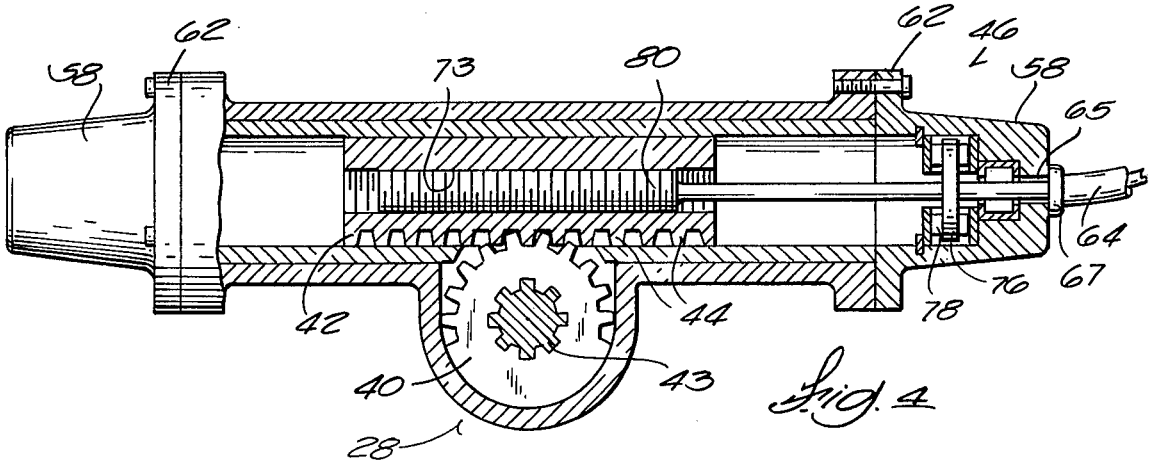
FIG. 4 is a view similar to the top sectional view shown in FIG. 3 illustrating an alternative embodiment of the invention.

FIG. 4 illustrates another alternative embodiment of the invention wherein the steering control means comprises rotary cable control means 46. The components of the steering assembly shown in FIG. 4 which are similar to the components of the steering assembly shown in FIGS. 1 through 3 are designated by the same reference numerals.

More specifically, in the construction shown in FIG. 4, the steering control means comprises a threaded sleeve 73 secured to the rack 42 and a rotary cable 64 having a threaded member 80 rotatably engaged within the sleeve 73 for effecting horizontal movement of the rack 42 when the cable 64 is rotated by any suitable mechanism (not shown). The steering control means also comprises means for preventing axial movement of the rotary cable thereby insuring that the rotation of the rotary cable 64 effects horizontal movement of the rack 42. In the illustrated construction, such means comprises the rotary cable 64 having a circular flange 76 supported for rotation within a thrust bearing 78 secured within one of the end members 58. The cable 64 preferably passes through an aperture 65 extending through an end portion of the end member including the thrust bearing 78, which end member 58 preferably includes a gasket 67 which seals the entrance of the aperture 65 around the cable 64.

While various arrangements can be utilized to thread or feed the hydraulic control lines 60 or the rotary cable 64 to the swivel bracket 28, in the illustrated construction, the boat transom 12 includes an aperture and gasket 70 through which the dhydraulic lines 60 pass. The hydraulic lines 60 or rotary cable 64 should have sufficient slack to permit the full range of vertical tilting movement of the lower unit 12 about th pivot pin 34.

It is to be understood that in the illustrated construction, the invention provides a marine propulsion device or outboard motor comprising a steering assembly wherein the rack and pinion are located within the swivel bracket and wherein the steering control means engages the swivel bracket to provide a sealed steering assembly which remains relatively unaffected by the external environment.

It is also to be understood that the invention provides a steering assembly for a marine propulsion device or outboard motor 10 wherein the rack and pinion effecting rotation of the pivot shaft 38 and lower unit 12 are located below the horizontal axis of the pivot pin 34 and the upper edge of the boat transom 32. Thus, as shown in the illustrated construction, the power head 16 of the outboard motor 10 can be supported by the mounting members of the pivot shaft 38 at a relatively lower height above the boat transom. Therefore, the invention enables use of an outboard motor having an overall reduction in height, a lower center of gravity, and increased stability which is particularly advantageous in boating applications requiring heavier, more powerful high performance engines. In addition, the invention provides a marine propulsion device or outboard motor having a steering assembly presenting a compact and clean appearance.

Various of the features of the invention are set forth in the following claims.

What is claimed is:

1. An outboard motor comprising a power head having an engine, a lower unit which carries said power head, said lower unit including a propeller adapted for rotation under water and a drive shaft housed within said lower unit and operatively coupled to said engine and to said propeller, and a swivel bracket adapted for mounting to a transom bracket for affording vertical tilting movement of said swivel bracket about a generally horizontal axis, said swivel bracket having a generally vertical bore and a generally horizontal cross bore which intersects said vertical bore, a pivot shaft supported within said vertical bore for rotation about a generally vertical axis, said pivot shaft having fixed thereto a pinion, and means for supporting said lower unit from said pivot shaft with said drive shaft being located in rearwardly spaced relation from said pivot shaft, a rack located in engagement with said pinion and supported within said horizontal cross bore to afford generally horizontal movement of said rack to effect rotation of said pinion and pivot shaft and said lower unit about said vertical axis, and steering control means for effecting horizontal movement of said rack so as to afford control of said rotation of said lower unit about said vertical axis, said rack and said steering control means being located below said generally horizontal axis.

2. An outboard motor in accordance with claim 1 wherein said swivel bracket includes a lower end, and wherein said rack and said steering means are located adjacent said lower end.

3. An outboard motor in accordance with claim 1 wherein said pivot shaft has an upper end and a lower end and said pinion is located between said ends, and wherein said lower unit supporting means comprises a yoke secured to said lower unit and to said upper end of said pivot shaft, and a lower mounting member secured to said lower unit and to said lower end of said pivot shaft.

4. An outboard motor in accordance with claim 1 wherein said steering control means comprises hydraulic control means.

5. An outboard motor in accordance with claim 1 wherein said steering control means comprises a threaded sleeve secured to said rack, a rotary cable having a threaded member rotatably engaged within said sleeve for effecting horizontal rack movement, and means for preventing axial movement of said rotary cable.

6. A steering assembly for an outboard motor including a power head having an engine and a lower unit which carries the power head, the lower unit including a propeller adapted for rotation under water and a drive shaft housed within the lower unit and operatively coupled to the engine and to the propeller, said steering assembly comprising a swivel bracket adapted for mounting to a transom bracket secured adjacent the upper edge of a boat transom, said swivel bracket being mounted to said transom bracket to afford vertical tilting movement of said swivel bracket about a generally horizontal axis, said swivel bracket having a generally vertical bore and a generally horizontal cross bore which intersects said vertical bore, a pivot shaft supported within said vertical bore for rotation about a generally vertical axis, said pivot shaft having fixed thereto a pinion and means for supporting the lower unit from said pivot shaft with the drive shaft being located in rearwardly spaced relation from said pivot shaft, a rack located in engagement with said pinion and supported within said horizontal cross bore to afford generally horizontal movement of said rack to effect rotation of said pinion and pivot shaft and the lower unit about said vertical axis, and steering control means for effecting horizontal movement of said rack and for affording control of lower unit rotation about said vertical axis, said rack and said steering control means being located below said generally horizontal axis and the boat transom.

7. A steering assembly in accordance with claim 6 wherein said swivel bracket includes a lower end, and wherein said rack is located adjacent said lower end.

8. A steering assembly in accordance with claim 7 wherein said pivot shaft has an upper end and a lower end and said pinion is located between said ends, and wherein the lower unit supporting means comprises a yoke secured to the lower unit and to said upper end of said pivot shaft, and a lower mounting member secured to the lower unit and to said lower end of said pivot shaft.

9. A steering assembly in accordance with claim 6 wherein said steering control means comprises hydraulic control means.

10. A steering assembly in accordance with claim 6 wherein said steering control means comprises a threaded sleeve secured to said rack, a rotary cable having a threaded member rotatably engaged within said sleeve for effecting said horizontal movement of said rack, and means for preventing axial movement of said rotary cable.

* * * * *